US009354534B2

(12) United States Patent
Okada

(10) Patent No.: US 9,354,534 B2
(45) Date of Patent: May 31, 2016

(54) ELECTROSTATIC LATENT IMAGE DEVELOPING TONER, METHOD FOR MANUFACTURING ELECTROSTATIC LATENT IMAGE DEVELOPING TONER, AND METHOD FOR FIXING ELECTROSTATIC LATENT IMAGE DEVELOPING TONER

(71) Applicant: KYOCERA Document Solutions Inc., Osaka (JP)

(72) Inventor: Seiji Okada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/482,215

(22) Filed: Sep. 10, 2014

(65) Prior Publication Data

US 2015/0072282 A1 Mar. 12, 2015

(30) Foreign Application Priority Data

Sep. 11, 2013 (JP) ..... 2013-188633

(51) Int. Cl.

*G03G 9/093* (2006.01)
*G03G 9/08* (2006.01)
*G03G 13/20* (2006.01)

(52) U.S. Cl.

CPC ..... *G03G 9/0825* (2013.01); *G03G 9/09314* (2013.01); *G03G 9/09328* (2013.01); *G03G 9/09342* (2013.01); *G03G 9/09392* (2013.01); *G03G 13/20* (2013.01)

(58) Field of Classification Search

CPC ..... G03G 9/09385
See application file for complete search history.

(56) References Cited

U.S. PATENT DOCUMENTS

| | | | | |
|---|---|---|---|---|
| 5,135,832 | A | 8/1992 | Sacripante et al. | |
| 7,405,000 | B2 | 7/2008 | Takikawa et al. | |
| 8,092,972 | B2 | 1/2012 | Zhou et al. | |
| 8,431,309 | B2 | 4/2013 | Zhou et al. | |
| 2005/0271964 | A1 | 12/2005 | Etou et al. | |
| 2006/0165989 | A1 | 7/2006 | Takikawa et al. | |
| 2007/0003855 | A1 * | 1/2007 | Veregin | G03G 9/0804 430/108.3 |
| 2010/0055592 | A1 | 3/2010 | Zhou et al. | |
| 2012/0107737 | A1 | 5/2012 | Zhou et al. | |

FOREIGN PATENT DOCUMENTS

| | | | |
|---|---|---|---|
| EP | 0485168 | A1 | 5/1992 |
| EP | 2159643 | A1 | 3/2010 |
| JP | S62-238578 | A | 10/1987 |

(Continued)

OTHER PUBLICATIONS

The extended European search report issued by the European Patent Office on Jan. 27, 2015, which corresponds to European Patent Application No. 14184187.4-1303 and is related to U.S. Appl. No. 14/482,215.

*Primary Examiner* — Hoa V Le
(74) *Attorney, Agent, or Firm* — Studebaker & Brackett PC

(57) ABSTRACT

An electrostatic latent image developing toner includes toner particles. Each toner particle includes a toner core containing a binder resin, a shell layer coating a surface of the toner core, and particulates having a higher hardness than the shell layer. Each shell layer contains a thermosetting resin, and the particulates are present within the shell layer. Preferably, the content of the particulates having a higher hardness than the shell layer is 0.1% by mass or more and 5.0% by mass or less with respect to a total amount of the toner particles.

6 Claims, 4 Drawing Sheets

(56) References Cited

FOREIGN PATENT DOCUMENTS

| | | | |
|---|---|---|---|
| JP | H06-170214 | A | 6/1994 |
| JP | H07-333887 | A | 12/1995 |
| JP | 2002-091060 | A | 3/2002 |
| JP | 2004-294467 | A | 10/2004 |
| JP | 2004-294468 | A | 10/2004 |
| JP | 2006-276069 | A | 10/2006 |
| JP | 2010-079318 | A | 4/2010 |

* cited by examiner

ELECTROSTATIC LATENT IMAGE DEVELOPING TONER, METHOD FOR MANUFACTURING ELECTROSTATIC LATENT IMAGE DEVELOPING TONER, AND METHOD FOR FIXING ELECTROSTATIC LATENT IMAGE DEVELOPING TONER

INCORPORATION BY REFERENCE

The present application claims priority under 35 U.S.C. §119 to Japanese Patent Application No. 2013-188633, filed Sep. 11, 2013. The contents of this application are incorporated herein by reference in their entirety.

BACKGROUND

The present disclosure relates to an electrostatic latent image developing toner, a method for manufacturing an electrostatic latent image developing toner, and a method for fixing an electrostatic latent image developing toner.

In the technical field of image forming as in copiers, an electrostatic latent image developing toner is fixed to a recording medium, such as paper, by applying heat and pressure through a fixing roller, for example. By the heat and pressure applied, the components of the toner melt or soften to be fixed to the recording medium. Desirably, the fixing is done in an energy saving manner and with a smaller fixing device. For this purpose, a toner is desired to be duly fixed to a recording medium while the heat and pressure applied to the fixing roller is kept to a minimum.

As a toner usable for such image forming, a study is underway for a toner including particles each having a surface coated with a urea resin.

SUMMARY

According to the present disclosure, an electrostatic latent image developing toner includes toner particles. Each toner particle includes a toner core containing a binder resin, a shell layer coating a surface of the toner core, and particulates having a higher hardness than the shell layer. Each shell layer contains a thermosetting resin, and the particulates having a higher hardness than the shell layer are present within the shell layer.

According to the present disclosure, a method for manufacturing an electrostatic latent image developing toner includes: preparing toner cores containing a binder resin; and forming shell layers coating surfaces of the respective toner cores. Each shell layer contains a thermosetting resin, and particulates having a higher hardness than the shell layer are present within the shell layer.

According to the present disclosure, a method for fixing an electrostatic latent image developing toner to a recording medium includes: supplying the electrostatic latent image developing toner to a surface of a recording medium; and applying a load of 5 N/cm$^2$ or more and 10 N/cm$^2$ or less to the recording medium to which the electrostatic latent image developing toner has been supplied.

DETAILED DESCRIPTION

The following describes embodiments of the present disclosure in detail. The present disclosure is not limited to the embodiments described blow, and various alterations may be appropriately made without departing from the object of the present disclosure. Note that some overlapping explanations may be appropriately omitted, but such omission is not intended to limit the gist of the disclosure.

An electrostatic latent image developing toner (which hereinafter may be referred to simply as "toner") according to an embodiment contains toner particles. Each toner particle includes a toner core containing a binder resin, a shell layer coating the surface of the toner core, and particulates having a higher hardness than the shell layer. Each shell layer contains a thermosetting resin, and the particulates are present within the shell layer. According to the present embodiment, the toner cores are anionic (negatively chargeable), whereas the shell layers are cationic (positively chargeable).

Figure 1:
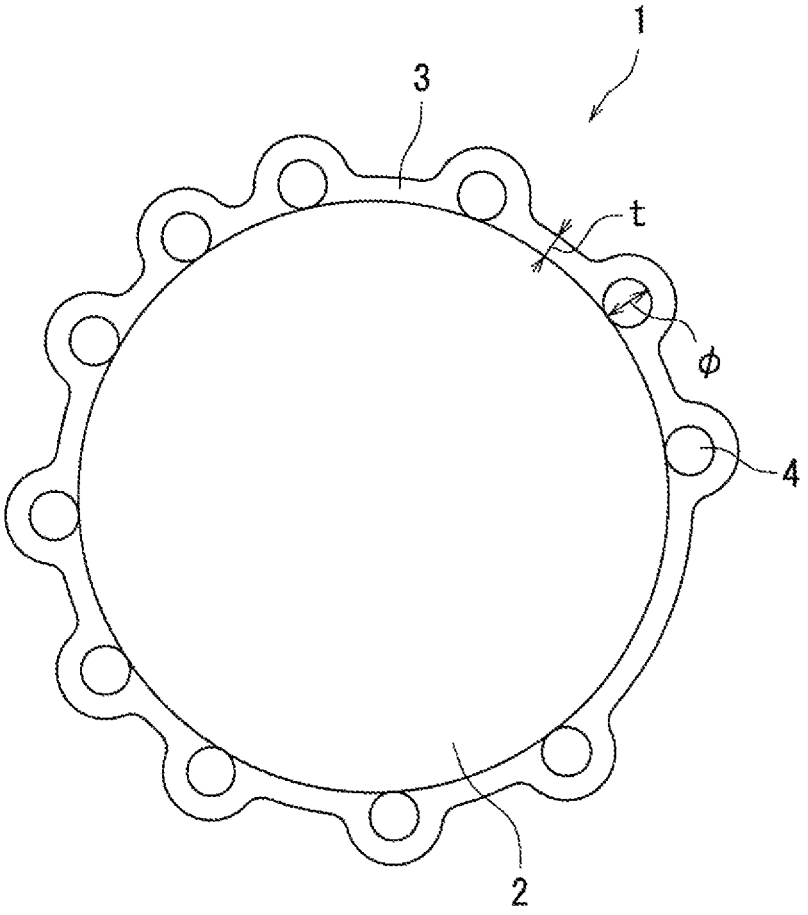
FIG. 1 shows a toner particle of an electrostatic latent image developing toner according to an embodiment.

The following describes the electrostatic latent image developing toner according to the present embodiment, with reference to FIG. 1.

The electrostatic latent image developing toner contains toner particles 1 one of which is shown in FIG. 1. As shown in FIG. 1, each toner particle 1 contains a toner core 2, a shell layer 3, and particulates 4. The toner core 2 corresponds to a toner component. The shell layer 3 contains a thermosetting resin and coats the surface of the toner core 2.

With the presence of the shell layer 3 containing a hard thermosetting resin, the toner particle 1 exhibits excellent blocking resistance, conveyance, and preservability. When a toner image formed of a toner containing the toner particles 1 is transferred to a recording medium, such as paper, and heat and load are applied to the toner image, the shell layers 3 rupture. As a result of the rupture of the shell layers 3, the toner cores 2 are exposed on the surfaces and melt or soften, so that the toner image is fixed to the recording medium.

Each particulate 4 in the toner particle 1 may serve as a starting point of the rupture. Therefore, although the shell layer 3 coating the surface of the toner core 2 contains a high hardness thermosetting resin, the shell layer 3 can be easily ruptured. This ensures the toner components to be sufficiently fixed to a recording medium with while the temperature and load necessary for fixing the toner image to the recording medium are significantly reduced.

In addition, the toner particle 1 shown in FIG. 1 is such that the diameter $\phi$ of the particulates 4 is greater than the thickness t of the shell layer 3. Thus, the particulates 4 coated with the shell layer 3 form protuberances. The toner particle 1 having protuberances formed of the particulates 4 coated with the shell layer 3 on the surface is advantageous in that the shell layer 3 can be easily ruptured.

The following describes the toner core 2.

The binder resin is an essential component of the toner core 2 and aniconic. The binder resin has a functional group which, for example, is an ester group, a hydroxyl group, a carboxyl group, an amino group, an ether group, an acid group, or a methyl group. The binder resin preferably has a functional group, such as a hydroxyl group, a carboxyl group, or an amino group, in a molecule, and more preferably has a hydroxyl group and/or a carboxyl group in a molecule. Such a function group is favorable because it reacts with a unit derived from a monomer of the thermosetting resin (for example, methylol melamine) contained in the shell layer 3 to be chemically bounded. As a result, the shell layer 3 and the toner core 2 of each toner particle 1 are strongly bonded to each other.

When the binder resin has a carboxyl group, for the toner core 2 to be sufficiently anionic, the acid value of the binder resin is preferably 3 mgKOH/g or more and 50 mgKOH/g or less, and more preferably 10 mgKOH/g or more and 40 mgKOH/g or less. When the binder resin has a hydroxyl group, for the toner cores 2 to be sufficiently anionic, the hydroxyl value of the binder resin is preferably 10 mgKOH/g or more and 70 mgKOH/g or less, and more preferably 15 mgKOH/g or more and 50 mgKOH/g or less.

Specific examples of the binder resin include thermoplastic resins (styrene-based resins, acrylic-based resins, styrene acrylic-based resins, polyethylene-based resins, polypropylene-based resins, vinyl chloride-based resins, polyester resins, polyamide-based resins, polyurethane-based resins, polyvinyl alcohol-based resins, vinyl ether-based resins, N-vinyl-based resins, and styrene-butadiene-based resins). Among these resins, styrene acrylic-based resins and/or polyester resins are preferred as the binder resin for improving the dispersibility of a colorant in the toner, the chargeability of the toner, and the fixability of the toner to a recording medium.

A styrene acrylic-based resin is a copolymer of a styrene-based monomer and an acrylic-based monomer. Specific examples of the styrene-based monomer include styrene, α-methylstyrene, p-hydroxystyrene, m-hydroxystyrene, vinyl toluene, α-chlorostyrene, o-chlorostyrene, m-chlorostyrene, p-chlorostyrene, and p-ethylstyrene.

Specific examples of the acrylic-based monomer include (meth)acrylic acid; (meth)acrylic acid alkyl ester (such as methyl(meth)acrylate, ethyl(meth)acrylate, n-propyl(meth)acrylate, iso-propyl(meth)acrylate, n-butyl(meth)acrylate, iso-butyl(meth)acrylate, and 2-ethylhexyl(meth)acrylate); and (meth)acrylic acid hydroxyalkyl ester (such as 2-hydroxyethyl(meth)acrylate, 3-hydroxypropyl(meth)acrylate, 2-hydroxypropyl(meth)acrylate, and 4-hydroxypropyl(meth)acrylate). Note that "(meth)acrylic acid" includes within the scope of its meaning acrylic acid and methacrylic acid and that "(meth)acrylate" includes within the scope of its meaning acrylate and methacrylate.

In preparation of the styrene acrylic-based resin, a hydroxy group can be introduced into the styrene acrylic-based resin by using a monomer having a hydroxyl group (such as p-hydroxystyrene, m-hydroxystyrene, or hydroxyalkyl(meth)acrylate). By appropriately adjusting the amount of the monomer having a hydroxyl group, the hydroxyl value of the resultant styrene acrylic-based resin can be adjusted.

In preparation of the styrene acrylic-based resin, a carboxyl group can be introduced into the styrene acrylic-based resin by using (meth)acrylic acid as the monomer. By appropriately adjusting the amount of the (meth)acrylic acid to be used, the acid value of the resultant styrene acrylic-based resin can be adjusted.

The polyester resin is obtained through condensation polymerization or co-condensation polymerization of a dihydric or trihydric or higher-hydric alcohol component and a dibasic or tribasic or higher-basic carboxylic acid component.

Examples of the dihydric alcohol component include diols (ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol); and bisphenols (bisphenol A, hydrogenated bisphenol A, polyoxyethylene-modified bisphenol A, and polyoxypropylene-modified bisphenol A). Examples of the trihydric or higher-hydric alcohol component include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of the dibasic carboxylic acid component include maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, and alkyl succinic acid or alkenyl succinic acid (such as n-butyl succinic acid, n-butenyl succinic acid, isobutyl succinic acid, isobutenyl succinic acid, n-octyl succinic acid, n-octenyl succinic acid, n-dodecyl succinic acid, n-dodecenyl succinic acid, isododecyl succinic acid, or isododecenyl succinic acid). Examples of the tribasic or higher-basic carboxylic acid component include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylene carboxy propane, 1,2,4-cyclohexanetricarboxylic acid, tetra(methylenecarboxyl) methane, 1,2,7,8-octanetetracarboxylic acid, pyromellitic acid, and Empol trimer acid. The carboxylic acid components may be used in the form of an ester-forming derivative (such as an acid halide, an acid anhydride, or a lower alkyl ester). The term "lower alkyl" used herein refers to an alkyl group having 1 to 6 carbon atoms.

The acid value and the hydroxyl value of the polyester resin can be adjusted by appropriately changing the amount of a dihydric or trihydric or higher-hydric alcohol component and a dibasic or tribasic or higher-basic carboxylic acid component to be used to produce the polyester resin. The acid value and the hydroxyl value of the polyester resin tend to be lower by increasing the molecular weight of the polyester resin.

When the binder resin is a polyester resin, the number average molecular weight Mn of the polyester resin is preferably 1,200 or more and 2,000 or less for improving the strength of the toner cores 2 and the fix ability of the toner particles 1. For the same reason, the molecular weight distribution of the polyester resin (Mw/Mn, which is the ratio of the mass average molecular weight Mw to the number average molecular weight Mn) is preferably 9 or more and 20 or less.

When the binder resin is a styrene acrylic-based resin, the number average molecular weight Mn of the styrene acrylic-based resin is preferably 2,000 or more and 3,000 or less for improving the strength of the toner cores 2 and the fixability of the toner particles 1. For the same reason, the molecular weight distribution of the styrene acrylic-based resin (Mw/Mn, which is the ratio of the mass average molecular weight Mw to the number average molecular weight Mn) is preferably 10 or more and 20 or less. Note that the number average molecular weight Mn and the mass average molecular weight Mw of the binder resin can be measured by using gel permeation chromatography.

The glass transition point Tg of the binder resin is preferably equal to or lower than the curing start temperature of the thermosetting resin contained in the shell layer 3 for improving the low-temperature fixability. With the binder resin having the glass transition point Tg falling within the above range, the toner exhibits sufficient fixability at the time of high-speed fixing. In particular, the glass transition point Tg of the binder resin is preferably 20° C. or more, and more preferably 30° C. or more and 55° C. or less, and further more preferably 30° C. or more and 50° C. or less. When the glass transition point Tg of the binder resin is 20° C. or more, aggregation of the toner cores 2 during the formation of the shell layers 3 are suppressed. Typically, the curing start temperature of a thermosetting resin is on the order of 55° C.

The glass transition point Tg of the binder resin can be determined based on the point of change in the specific heat of the binder resin measured by using a differential scanning calorimeter (DSC). More specifically, a differential scanning calorimeter (for example, "DSC-6200" manufactured by Seiko Instruments Inc.) can be used as the measuring device to obtain the heat absorption curve of the binder resin to determine the glass transition point Tg of the binder resin. Alternatively, the glass transition point Tg of the binder resin can be measured in the following manner. First, a 10 mg measurement sample (the binder resin) is put in an aluminum pan. With an empty aluminum pan used as a reference, a heat absorption curve of the binder resin is obtained within a measurement temperature range of 25° C. to 200° C. and a heating rate of 10° C./min. Then, based on the heat absorption curve thus obtained, the glass transition point Tg of the binder resin can be determined.

The softening point Tm of the binder resin is preferably 100° C. or less, and more preferably 95° C. or less. With the binder resin having the softening point Tm of 100° C. or less, the toner exhibits sufficient fixability at the time of high-speed fixing. The softening point Tm of the binder resin can be adjusted by, for example, combining a plurality of resins having different softening points Tm.

The softening point Tm of the binder resin can be measured by using an elevated flow tester (for example, "CFT-500D" manufactured by Shimadzu Corporation). More specifically, a measurement sample (binder resin) is set on the elevated flow tester, 1 $cm^3$ of the sample is melt flown under predetermined conditions (dies diameter: 1 mm, plunger load: 20 $kg/cm^2$, and heating rate: 6° C./min) to obtain an S shaped curve (S shaped curve plotted on the temperature (° C.)/stroke (mm)). The softening point Tm of the binder resin is read from the S shaped curve.

Figure 2:
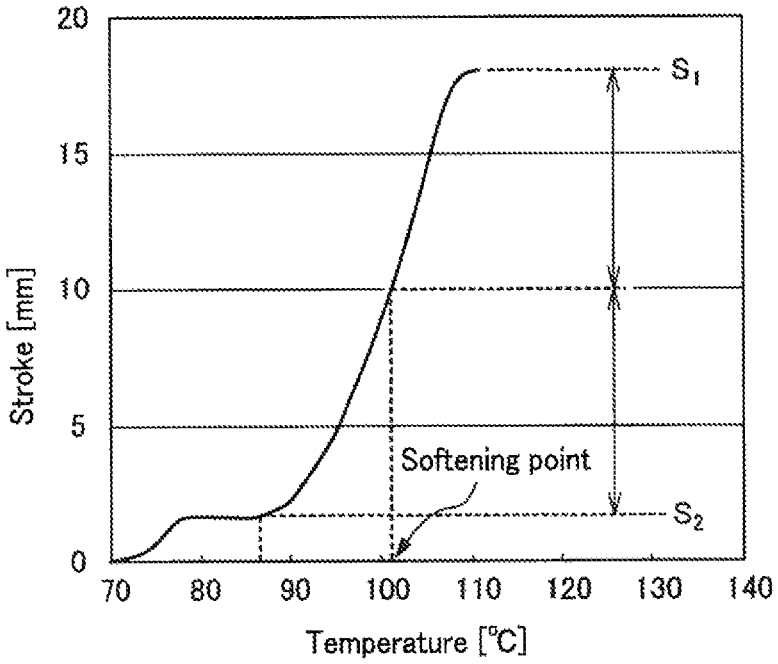
FIG. 2 illustrates a method for measuring a softening point by using an elevated flow tester.

With reference to FIG. 2, the following describes how to read the softening point Tm of the binder resin. In FIG. 2, $S_1$ represents the maximum value of the stroke, and $S_2$ represents a stroke value corresponding to a base line at the lower temperature side than the temperature of $S_1$. On the S shaped curve, a temperature corresponding to a stroke value given by $(S_1+S_2)/2$ is determined as the softening point Tm of the measurement sample (binder resin).

Still with reference to FIG. 1, the following describes the toner particle 1. The toner core 2 may contain, as a colorant, a known pigment or dye corresponding to the color of the toner particle 1. An example of the black colorant includes carbon black. Also, a combination of colorants, such as a later-described yellow colorant, magenta colorant, and cyan colorant adjusted to be black is usable as the black colorant.

When the electrostatic latent image developing toner is a color toner, the colorant contained in the toner cores 2 may be a yellow colorant, a magenta colorant, or a cyan colorant.

Examples of the yellow colorant include condensed azo compounds, isoindolinone compounds, anthraquinone compounds, azo metal complexes, methine compounds, and allylamide compounds. Specific examples include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Bat Yellow.

Examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific example includes C.I. Pigment Red (2, 3, 5, 6, 7, 19, 23, 48:2, 48:3, 48:4, 57:1 81:1, 122, 144, 146, 150, 166, 169, 177, 184, 185, 202, 206, 220, 221, or 254).

Examples of the cyan colorant include copper phthalocyanine compounds, copper phthalocyanine derivatives, anthraquinone compounds, and basic dye lake compounds. Specific examples include the cyan colorant include C.I. Pigment Blue (1, 7, 15, 15:1, 15:2, 15:3, 15:4, 60, 62, or 66), phthalocyanine blue, C.I. Bat Blue, and C.I. Acid Blue.

The content of the colorant in the toner core 2 is preferably 1 part by mass or more and 10 parts by mass or less with respect to 100 parts by mass of the binder resin, and more preferably 3 parts by mass or more and 7 parts by mass or less.

The toner core 2 may contain a release agent for improving the fixability as well as for suppressing occurrence of offset or image smearing (smudge of printed image caused by rubbing). Examples of the release agent include: aliphatic hydrocarbon-based waxes (such as low molecular weight polyethylene, low molecular weight polypropylene, polyolefin copolymers, polyolefin wax, microcrystalline wax, paraffin wax, and Fischer-Tropsch wax); oxides of the aliphatic hydrocarbon-based waxes (such as polyethylene oxide wax, and a block copolymer of polyethylene oxide wax); vegetable waxes (such as candelilla wax, carnauba wax, haze wax, jojoba wax, and rice wax); animal waxes (such as beeswax, lanolin, and spermaceti wax); mineral waxes (such as ozokerite, ceresin, and petrolatum); waxes containing a fatty acid ester as a principal component (such as montanic acid ester wax, and castor wax); and waxes obtained by deoxidizing part or whole of fatty acid ester (such as deoxidized carnauba wax).

When the toner core 2 contains a release agent, the content of the release agent is preferably 1 part by mass or more and 5 parts by mass or less with respect to 100 parts by mass of the binder resin, for example.

The toner core 2 may contain a charge control agent as needed. The presence of the charge control agent improves the charge level or the charge rising property to yield a toner having excellent durability or stability. The charge rising property serves as an index of whether or not the toner can be charged to a predetermined charge level in a short period of time. Since the toner core 2 is anionic (negatively chargeable), a negatively chargeable charge control agent is usable.

The toner core 2 may contain magnetic powder as needed. When the toner cores 2 containing magnetic powder are used to prepare the toner particles 1, the electrostatic latent image developing toner containing the toner cores 2 is used as a magnetic one-component developer. Suitable examples of the magnetic powder include iron (such as ferrite or magnetite), ferromagnetic metals (such as cobalt or nickel), alloys containing iron and/or a ferromagnetic metal, compounds containing iron and/or a ferromagnetic metal, ferromagnetic alloys having been ferromagnetized by for example heating, and chromium dioxide.

The particle diameter of the magnetic powder is preferably 0.1 nm or more and 1.0 nm or less, and more preferably 0.1 nm or more and 0.5 nm or less. The magnetic powder having a particle diameter falling within the above range is readily and uniformly dispersed in the binder resin.

In an electrostatic latent image developing toner used as a one-component developer, the content of the magnetic powder is preferably 35 parts by mass or more and 60 parts by mass or less with respect to 100 parts by mass of the total amount of the toner, and more preferably 40 parts by mass or more and 60 parts by mass or less. In an electrostatic latent image developing toner used as a two-component developer, the content of the magnetic powder is preferably 20 parts by mass or less with respect to 100 parts by mass of the total amount of the toner, and more preferably 15 parts by mass or less.

The following describes the shell layer 3.

The thermosetting resin, which is an essential component of the shell layer 3, has a sufficient strength and hardness and is cationic. Throughout the specification and the claims of the present application, the thermosetting resin contains a unit obtained by introducing a methylene group ($—CH_2—$) derived from formaldehyde into a monomer such as melamine, for example.

Examples of the thermosetting resin include a melamine resin, a urea resin (urea resorcinol-based resin), a guanamine resin, a urethane resin, an amide resin, an olefin resin, and a gelatin-gum arabic resin. Among the thermosetting resins, a melamine resin or a urea resin is preferred as such a resin does not require a significant increase in the fixing temperature.

A melamine resin is a polycondensate of melamine and formaldehyde, and one of the monomers used for forming a melamine resin is melamine. A urea resin is a polycondensate of urea and formaldehyde, and one of the monomers used for forming a urea resin is urea. The melamine or urea may be denatured in a known manner.

The shell layer 3 may contain a resin other than the thermosetting resin as needed, on condition that the presence of such a resin does not impair the effect of the present disclosure. The content of the thermosetting resin in the shell layer 3 is preferably 90% by mass or more and 100% by mass or less with respect to the total amount of the shell layer 3, and more preferably 95% by mass or more and 100% by mass or less. With the thermosetting resin content of 90% by mass or more, the shell layer 3 will have a sufficient hardness.

The presence of nitrogen atoms in a material facilitates the material to be positively charged to a desired level. Therefore, the shell layer 3 preferably contains nitrogen atoms derived from melamine or urea. To positively charge the shell layer 3 to a sufficient level, the content of the nitrogen atoms in the shell layer 3 is preferably 10% by mass or more.

The thickness t of the shell layer 3 is preferably smaller than the average diameter $\phi$ of the particulates 4. For example, the thickness t of the shell layer 3 may be 7 nm or more and 80 nm or less. The thickness t of the shell layer 3 can be measured by, for example, analyzing a cross-sectional TEM image of the toner particle 1 with commercially available image analyzing software (for example, "WinROOF" manufactured by MITANI CORPORATION).

As described above, the particulates 4 having a higher hardness than the shell layer 3 are present within the shell layer 3. The sufficient hardness of the particulates 4 is at least one grade higher than that of the shell layer 3 as measured according to JIS K5600 (pencil hardness test), and preferably at least two grades higher.

Examples of the particulates 4 include particulates of metal oxides (such as alumina, titanium oxide, magnesium oxide, zinc oxide, strontium titanate, and barium titanate) and particulates of an inorganic material, such as silica.

The diameter $\phi$ of the particulates 4 is preferably 10 nm or more and 100 nm or less when measured in terms of the primary particle diameter, and more preferably 10 nm or more and 50 nm or less. With the particulates 4 having a diameter (primary particle diameter) of 10 nm or more, the shell layers 3 can be ruptured easily and thus the temperature and the load for fixing can be sufficiently reduced. On the other hand, with the particulates 4 having a diameter (primary particle diameter) of 100 nm or less, excessive charge-up of the resultant electrostatic latent image developing toner can be suppressed and reduction of the density of image to be formed can be suppressed.

The amount of the particulates 4 contained in the shell layers 3 is preferably 0.1% by mass or more and 5.0% by mass or less with respect to the total amount of the toner particles 1, and more preferably 0.1% by mass or more and 4.5% by mass or less. With the shell layers 3 containing the particulates 4 in an amount of 0.1% by mass or more of the toner particles 1, the shell layers 3 can be easily ruptured. This allows the temperature and load necessary for fixing to be significantly reduced. On the other hand, with the shell layers 3 containing the particulates 4 in an amount of 5.0% by mass or less of the toner particles 1, excessive charge-up of the resultant electrostatic latent image developing toner can be suppressed and reduction of the density of image to be formed can be suppressed.

The number of particulates 4 contained in a shell layer 3 is calculated based on the bulk density of the particulates 4, for example. The number of particulates 4 contained in the shell layer 3 is 50,000 or more and 550,000 or less per toner particle, for example.

The shell layer 3 may contain a charge control agent. Since the shell layer 3 is cationic (positively chargeable), a positively chargeable charge control agent can be contained.

Figure 3:
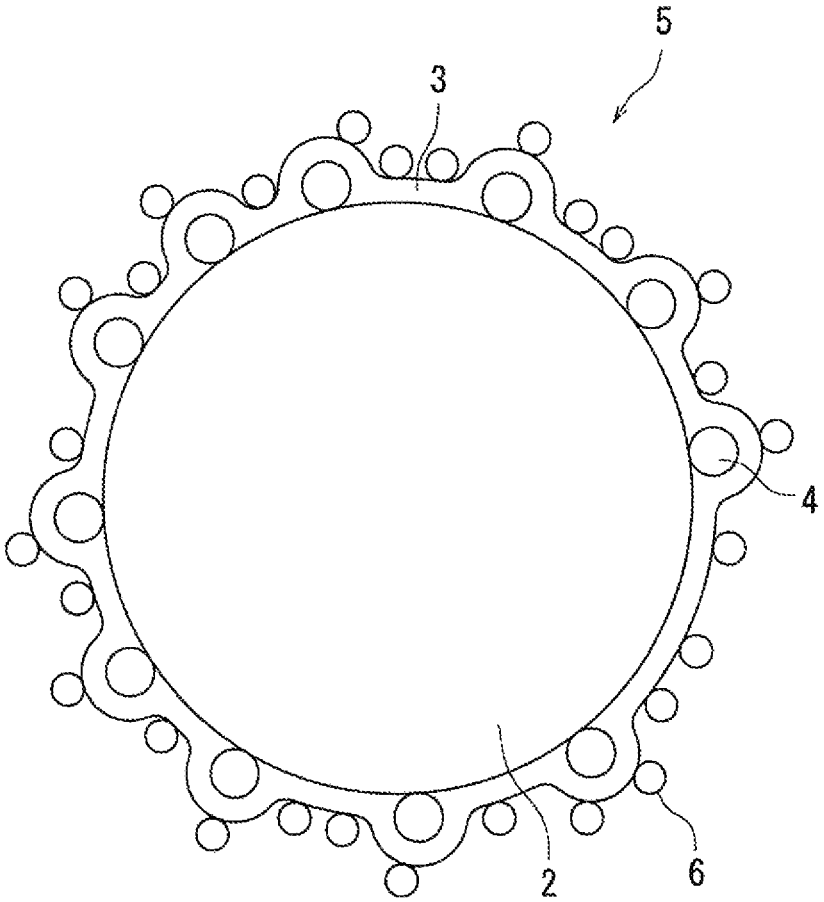
FIG. 3 shows a toner particle of an electrostatic latent image developing toner according to another embodiment.

FIG. 3 shows a toner particle 5 contained in an electrostatic latent image developing toner according to another embodiment. As shown in FIG. 3, the toner particle 5 includes a toner core 2, a shell layer 3, particulates 4, and an external additive 6. More specifically, the surface of the shell layer 3 is treated by externally adding the external additive 6 for improving the fluidity and handleability. The external addition treatment with the external additive 6 is not particularly limited and a known method can be used. More specifically, the external addition treatment is performed by using a mixer (for example, FM mixer or Nauta mixer (registered trademark)) under the conditions ensuring that the external additive 6 is not embedded in the shell layer 3.

Examples of the external additive 6 include the particles of silica and metal oxides (such as alumina, titanium oxide, magnesium oxide, zinc oxide, strontium titanate, and barium titanate). The particle diameter of the external additive 6 is preferably 0.01 μm or more and 1.0 μm or less for improving the fluidity and handleability.

The toner particle 1 before the treatment with the external additive 6 (a toner particle containing the toner core 2, the shell layer 3, and the particulates 4) may be referred to as a "toner mother particle". The amount of the external additive 6 to be used is preferably 1 part by mass or more and 10 parts by mass or less with respect to 100 parts by mass of the toner mother particles, and more preferably 2 parts by mass or more and 5 parts by mass or less for improving the fluidity and handleability.

Up to this point, the description is given of the toner particles 1 and the toner particles 5 contained in the electrostatic latent image developing toners according to the present disclosure with reference to FIGS. 1 to 3. Each electrostatic latent image developing toner according to the present disclosure may further contain magnetic powder, such as ferrite or magnetite, to be used as a one-component developer. Alternatively, each electrostatic latent image developing toner according to the present disclosure may be mixed with a desired carrier to be used as a two-component developer.

As for the carrier, the magnetic carrier is preferred. Specific examples of the magnetic carrier include one containing carrier cores coated with a resin. Examples of the carrier core include: particles of iron, oxidized iron, reduced iron, magnetite, copper, silicon steel, ferrite, nickel, or cobalt; particles of alloys of one or more of these materials and a metal, such as manganese, zinc, or aluminum; particles of iron-nickel alloys or iron-cobalt alloys; particles of ceramics, such as titanium oxide, aluminum oxide, copper oxide, magnesium oxide, lead oxide, zirconium oxide, silicon carbide, magnesium titanate, barium titanate, lithium titanate, lead titanate, lead zirconate, and lithium niobate; and particles of high-dielectric substances, such as ammonium dihydrogen phosphate, potassium dihydrogen phosphate, and Rochelle salt. In addition, a resin carrier containing any of the particles mentioned above (magnetic particles) dispersed in a resin is usable as the material of a carrier core.

Examples of the resin that coats the carrier core include (meth)acrylic-based polymers, styrene-based polymers, styrene-(meth)acrylic-based copolymers, olefin-based polymers (polyethylene, chlorinated polyethylene, and polypropylene), polyvinyl chloride, polyvinyl acetate, polycarbonate, cellulose resins, polyester resins, unsaturated polyester resins, polyamide resins, polyurethane resins, epoxy resins, silicone resins, fluorine resins (polytetrafluoroethylene, polychlorotrifluoroethylene, and polyvinylidene fluoride), phenol resins, xylene resins, diallylphthalate resins, polyacetal resins, and amino resins. These resins may be used singly or two or more types may be used in combination. Note that "(meth)acrylic-based" includes within the scope of its meaning acrylic-based and methacrylic-based.

The particle diameter of the carrier measured by using an electron microscope is preferably 20 nm or more and 120 nm or less, and more preferably 25 nm or more and 80 nm or less.

When each electrostatic latent image developing toner according to the present disclosure is used as a two-component developer, the amount of the electrostatic latent image developing toner to be used is preferably 3% by mass or more and 20% by mass or less with respect to the mass of the two-component developer, and more preferably 5% by mass or more and 15% by mass or less.

Each electrostatic latent image developing toner according to the present disclosure contains toner particles each having a surface coated with a shell layer containing a hard thermosetting resin. Yet, each electrostatic latent image developing toner according to the present disclosure can be sufficiently fixed at a significantly lower fixing temperature and with a significantly small fixing load. Each electrostatic latent image developing toner according to the present disclosure can be favorably used in an image forming method, such as an electrophotographic method.

The manufacturing method according to an embodiment of the present disclosure involves a preparatory process (preparing) and a formation process (forming) In the preparatory process, toner cores 2 containing a binder resin are prepared. In the formation process, shell layers 3 are formed to coat the surfaces of the respective toner cores 2. The shell layers 3 contain a thermosetting resin, and particulates 4 having a higher hardness than the shell layers 3 are present within each shell layer 3.

To conduct the preparatory process, it is sufficient that components other than the binder resin (such as a colorant, charge control agent, release agent, and/or magnetic powder) are dispersed well in the binder resin. Examples of the method employed for conducting the preparatory process include a melting and kneading method and a polymerization method.

The melting and kneading method is employed in the following manner. First, the binder resin is mixed with components other than the binder resin as needed. As a result, a mixture is obtained. The resultant mixture is melted and kneaded. The resultant mixture melted and kneaded is crushed by a known scheme to obtain crushed particles. The resultant particles are classified by a known scheme to obtain toner cores 2 having a desired diameter.

Examples of the polymerization method include the following. In one example, a mixture melted and kneaded is obtained in the same manner as the melting and kneading method, and the resultant mixture melted and kneaded is sprayed into the air by using a disk or a multi-fluid nozzle to obtain toner cores. In another example, the toner cores are directly generated through suspension polymerization. A yet another example is a dispersion polymerization method for directly generating the toner cores by using an aqueous organic solvent in which a monomer is soluble but a polymer to be obtained is not soluble. A yet another example is an emulsion polymerization method, such as a so-called soap-free polymerization, of directly generating the toner cores through polymerization caused in the presence of an aqueous polar polymerization initiator. A yet another example is a heteroaggregation method in which polar primary particles are prepared though emulsion polymerization, followed by adding oppositely charged polar particles to cause aggregation.

The formation process involves an adhering process, a first supply process, and a first resinifying process. In the adhering process, the particulates 4 are caused to adhere to the surfaces of the toner cores 2. In the first supply process, a shell-layer-forming liquid containing a monomer and/or a prepolymer of the thermosetting resin is supplied to the surfaces of the toner cores 2. In the first resinifying process, the monomer and/or the prepolymer of the thermosetting resin contained in the shell-layer-forming liquid are resinified.

When the formation process of forming the shell lasers 3 involves the adhering process, the first supply process, and the first resinifying process, the electrostatic latent image developing toner can be manufactured to have the toner particles 1 containing the particulates 4 that are evenly dispersed in the shell layers 3. In addition, the adhering process conducted immediately upon the manufacture of the toner cores 2 can improve the handleability and the fluidity of the toner cores 2 during storage.

In the adhering process, the particulates 4 are caused to adhere to the surface of each toner core 2 obtained in the preparatory process. The particulates 4 can be caused to adhere to the surfaces of the toner cores 2 by, for example, mixing the toner cores 2 with the particulates 4 using a mixer (FM mixer or Nauta mixer (registered trademark)) under the conditions ensuring that the particulates 4 are not fully embedded in the toner cores 2.

In the first supply process, the shell-layer-forming liquid is supplied to the surfaces of the toner cores 2. The shell-layer-forming liquid contains a monomer and/or a prepolymer of the thermosetting resin. Examples of the method for supplying the shell-layer-forming liquid to the toner cores 2 include a method in which the shell-layer-forming liquid is sprayed to the surfaces of the toner cores 2 and a method in which the toner cores 2 are immersed in the shell-layer-forming liquid.

The shell-layer-forming liquid is prepared by, for example, stirring and mixing a solvent, a monomer and/or a prepolymer of the thermosetting resin, and other additives (for example, dispersant, which will be described later) as needed. Examples of the solvent include toluene, acetone, methyl ethyl ketone, tetrahydrofuran, and water.

The monomers of the thermosetting resin described above are appropriately selected. In addition the prepolymers of the thermosetting resin described above are obtained by increasing the polymerization degree of the monomers of the thermosetting resin to a certain extent to reach the state just before the monomers become polymerized. Therefore, the prepolymers may also be referred to as initial polymers or initial condensate.

The shell-layer-forming liquid may contain a known dispersant to improve the dispersibility of the monomer and/or the prepolymer of the thermosetting resin in a solvent. The content of the dispersant in the shell-layer-forming liquid is 0.1% by mass or more and 15% by mass or less, for example. With the dispersant content of 0.1% by mass or more in the shell-layer-forming liquid, good dispersibility is ensured. On the other hand, with the dispersant content of 15% by mass or less in the shell-layer-forming liquid, the environmental impact caused by the dispersant can be reduced. The dispersant can be removed by conducting, for example, a washing process after the manufacture of the electrostatic latent image developing toner according to the present embodiment.

In the first resinifying process conducted after the first supply process, the monomer and/or the prepolymer of the thermosetting resin contained in the shell-layer-forming liquid are resinified into a thermosetting resin through any polymerization or condensation. As a result, the shell layers 3 are formed on the surfaces of the respective toner cores 2. The scope of the resinification referred herein covers resinification into a resin having a sufficiently high polymerization degree as well as resinification into a resin having a medium polymerization degree.

The first resinifying process is carried out at the reaction temperature (resinifying temperature) maintained preferably within the range of 40° C. to 90° C., and more preferably within the range of 50° C. to 80° C. With the reaction temperature of 40° C. or more, the resultant shell layers 3 will have a sufficient hardness. On the other hand, with the reaction temperature of 90° C. or less, the resultant shell layers 3 are prevented from being excessively hard. This ensures that the shell layers 3 can be readily ruptured in response to heat and pressure applied for fixing.

The formation process may involve the following processes instead of the first supply process and the first resinifying process. That is, the formation process may involve a second supply process and a second resinifying process. In the second supply process, a shell-layer-forming liquid containing a monomer and/or a prepolymer of the thermosetting resin and the particulates 4 is supplied to the surfaces of the toner cores 2. In the second resinifying process, the monomer and/or the prepolymer of the thermosetting resin contained in the shell-layer-forming liquid supplied to the surfaces of the toner cores 2 are resinified. Note that the particulates 4 have a higher hardness than the shell layers 3. When the formation process to form the shell layers involves the second supply process and the second resinifying process, the electrostatic latent image developing toner according to the present disclosure can be manufactured through less complicated processes as compared with when the formation process to form the shell layers involves the first supply process and the first resinifying process.

The method for preparing the shell-layer-forming liquid in the second supply process is not particularly limited. For example, the monomer and/or the prepolymer of the thermosetting resin, the particulates 4, and various additives as needed (for example, a positively-charging agent or dispersant) are added to any solvent, appropriately followed by stirring and mixing. The solvent, the monomer and/or the prepolymer of the thermosetting resin, and the dispersant to be used are the same as those used in the preparation of the shell-layer-forming liquid in the first supply process.

Examples of the method employed in the second supply process for supplying the shell-layer-forming liquid to the toner cores 2 include a method in which the shell-layer-forming liquid is sprayed to the surfaces of the toner cores 2 and a method in which the toner cores 2 are immersed in the shell-layer-forming liquid.

In the second resinifying process, the monomer and the prepolymer of the thermosetting resin are resinified to form the shell layers, and thus the electrostatic latent image developing toner containing the toner particles is obtained. The second resinifying process can be conducted under the same conditions or in the same scheme employed for the first resinifying process.

Up to this point, the manufacturing method according to the present embodiment has been described. The toner particles contained in the electrostatic latent image developing toner after the formation process of the manufacturing method according to the present embodiment may further be subjected to one or more processes selected from a washing process, a drying process, and an external addition process as needed.

In the washing process, the toner particles contained in the electrostatic latent image developing toner obtained by conducting the formation process are washed with water, for example.

In the drying process, the toner particles having been washed are dried by using, for example, a dryer (such as a spray dryer, a fluidized bed dryer, a vacuum freeze dryer, or a reduced pressure dryer). The use of a spray dryer is preferred for easy suppression of aggregation of the toner particles during the drying. When a spray dryer is used, a dispersion of the external additive 6 (for example, silica particulates) can be sprayed during the drying. Therefore, the external addition process, which will be described later, can be conducted at the same time.

With reference to FIGS. 1 and 3, the following describes the external addition process. In the external addition process, the external additive 6 is caused to adhere to the surface of each toner particle 1. Suitable examples of the method for causing the external additive 6 to adhere include a method in which the electrostatic latent image developing toner containing the toner particles 1 are mixed with the external additive 6 by using a mixer (for example, FM mixer or Nauta mixer (registered trademark)) under the conditions ensuring that the external additive 6 is not embedded in the surfaces of the shell layers 3. As a result, the electrostatic latent image developing toner containing the toner particles 5 is manufactured.

With reference to FIG. 1, the following describes a method, according to an embodiment of the present disclosure, for fixing an electrostatic latent image developing toner to a recording medium. The fixing method according to the present embodiment involves a toner supplying process and a load applying process. In the toner supplying process, the electrostatic latent image developing toner is supplied to the surface of the recording medium. In the load applying process, a load of 5 $N/cm^2$ or more and 10 $N/cm^2$ or less is applied to the recording medium of which the electrostatic latent image developing toner has been supplied to the surface.

In the toner supplying process, a toner image is developed in the following manner before the electrostatic latent image developing toner is supplied to the surface of the recording medium. To develop the toner image by an image forming apparatus, a scheme using, for example, corona discharge is employed to charge the surface of the image bearing member. Thereafter, the charged surface of the image bearing member is exposed to a beam or the like, to form an electrostatic latent image on the surface of the image bearing member. Then, the electrostatic latent image developing toner is supplied to the surface of the image bearing member bearing the electrostatic latent image. The portions of the surface exposed to light attracts the electrostatic latent image developing toner, so that the electrostatic latent image is developed into a toner image. Next, the toner image is transferred from the image bearing member to the recording medium by the transfer roller, so that the electrostatic latent image developing toner is supplied to the recording medium.

In the load applying process, a load of 5 N/cm$^2$ or more and 10 N/cm$^2$ or less is applied to the recording medium of which the electrostatic latent image developing toner has been supplied to the surface. As a result, the electrostatic latent image developing toner is fixed to the recording medium.

Figure 4:
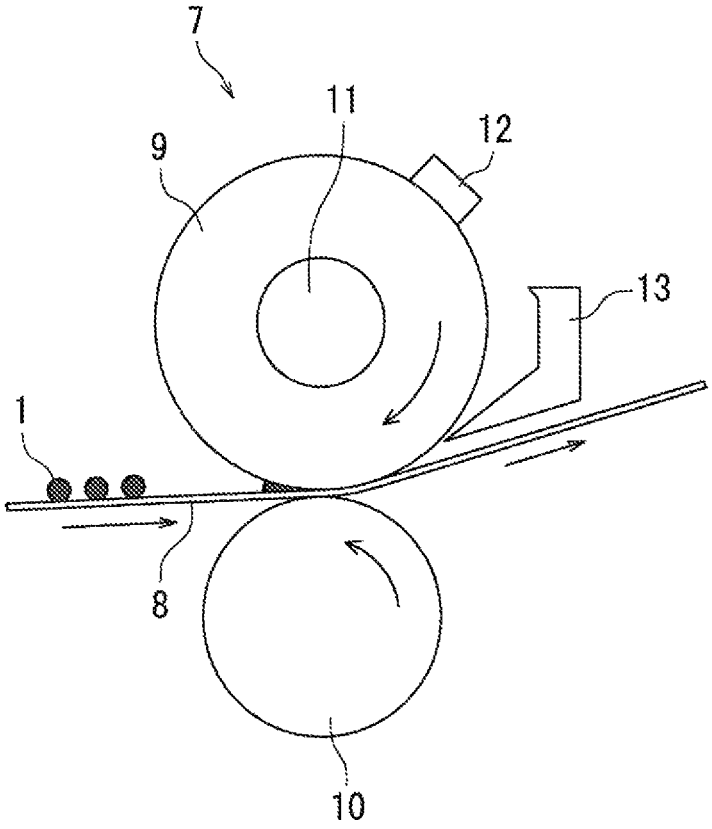
FIG. 4 is a schematic view of a fixing unit used in a fixing method according to an embodiment.

FIG. 4 shows an example of a fixing unit 7 for conducting the load applying process. With reference to FIGS. 1 and 4, the following describes the load applying process in detail. The fixing unit 7 includes a heating roller 9, a pressure roller 10, a heat source 11, a temperature measuring member 12, and a separating member 13. The heating roller 9 heats the recording medium 8 by using the heat source 11 (for example, a halogen heater). The temperature measuring member 12 measures the temperature of the heating roller 9 being heated. The pressure roller 10 is disposed to face the heating roller 9 and applies load to the recording medium 8. The separating member 13 separates the recording medium 8 from the heating roller 9 after the load applying process.

More specifically, the fixing unit 7 causes the recording medium 8 to which the electrostatic latent image developing toner has been supplied to pass between the heating roller 9 and the pressure roller 10 so as to apply heat and load to the recording medium 8 and the electrostatic latent image developing toner residing thereon. In response, the shell layers 3 of the electrostatic latent image developing toner rupture, so that the toner cores 2 melt and soften to be fixed to the recording medium 8. The load applied for fixing can be adjusted by appropriately changing the load applied by the pressure roller 10 and the nip width. The nip width refers to the width across which the pressure roller 10 is in contact with the heating roller 9. Thereafter, the recording medium 8 is peeled away and separated from the heating roller 9 by the separating member 13.

The fixing method according to the present embodiment is a so-called heating and pressurizing method involving the use of a heating roller and a pressure roller. One or more of the particulates 4 present within the shell layers 3 serve as a starting point of rupturing of the shell layers 3, ensuring that the shell layers 3 readily rupture upon application of heat and pressure. As a result, the fixing temperature and fixing load necessary for fixing the electrostatic latent image developing toner to the recording medium can be substantially reduced.

In the fixing method according to the present embodiment for fixing an electrostatic latent image developing toner, the fixing load can be reduced to fall within the range of 5 N/cm$^2$ to the 10 N/cm$^2$. With the fixing load of 10 N/cm$^2$ or less, the recording medium is not subjected to an excessive load at the time of the fixing. This improves the durability and conveyance of the recording medium and helps protecting the recording medium from occurrence of defects (such as wrinkles) resulting from the excessive pressure. This additionally helps preventing the deterioration and the cost increase of the component members (especially of the rubber members) of the fixing unit. On the other hand, the fixing load of 5 N/cm$^2$ or higher improves the fixability. Note that the fixing load necessary for a typical electrostatic latent image developing toner is 20 N/cm$^2$ or more and 100 N/cm$^2$ or less.

With the fixing method according to the present embodiment, the fixing temperature can be reduced by 5° C. or so as compared with the fixing of an electrostatic latent image developing toner containing no particulates 4 in the shell layers 3. As a result, the load imposed by heat is reduced and thus the durability of the recording medium can be improved. In addition, the deterioration and the cost increase of the component members of the fixing unit can be suppressed.

With the fixing method according to the present embodiment, the fixing time can be 20 msec or more and 70 msec or less, for example. Preferably, the fixing time can be 20 msec or more and 50 msec or less.

EXAMPLES

The following more specifically describes the present disclosure by way of examples. However, the present disclosure is not limited to these examples.

Example 1

Preparatory Process

By using an FM mixer, 100 parts by mass of a polyester resin (manufactured by Kao Corporation, an acid value of 16 mgKOH/g, a hydroxyl value of 22 mgKOH/g, a softening point Tm of 100° C., and a glass transition point Tg of 48° C.) was mixed with 5 parts by mass of a colorant (C.I pigment blue 15:3 type, copper phthalocyanine) and 5 parts by mass of a release agent (ester wax, "WEP-3" manufactured by NOF Corporation) to prepare a mixture. The resultant mixture was melted and kneaded by a two-axis extruder ("PCM-30" manufactured by Ikegai Corp). The resultant kneaded matter was pulverized by a mechanical pulverizer ("Turbo Mill" manufactured by FREUND-TURBO CORPORATION), followed by classification by a classifier ("Elbow-Jet" manufactured by Nittetsu Mining Co., Ltd.) to obtain toner cores A having a volume median diameter of 6 μm. By the following pencil hardness test, the hardness of the polyester resin prior to the pulverization was measured to be the "H" grade.

Adhering Process

To the toner cores A, the silica particulates ("E-220A" manufactured by Tosoh Corporation, a particle diameter of 16 nm, and a pencil hardness of 8H or a higher grade) is added such that the amount of the silica particulates adhered is 1% by mass of the total amount of the toner cores. Then, the resultant was mixed by an FM mixer to cause the silica particulates to adhere to the surfaces of the toner cores A.

Supply Process

A 1-litter, three-necked flask was set in a water bath kept at 30° C. In the flask, the pH of the ion exchanged water (300 mL) was adjusted to 4 by using hydrochloric acid. In the resultant ion exchanged water, 2 mL of an aqueous solution containing initial polymers of hexamethylolmelamine ("Mirben resin SM-607" manufactured by Showa Denko K.K., a solid concentration of 80% by mass) was dissolved to obtain a shell-layer-forming liquid. To the shell-layer-forming liquid, 300 g of the toner cores A resulting from the adhering process were added.

Resinifying Process

The shell-layer-forming liquid and the toner cores A were stirred at 200 rpm for one hour. Then, 500 mL of the ion exchanged water was added to the flask. While the content of the flask was stirred at 100 rpm, the temperature inside the flask was raised up to 80° C. at the heating rate of 1° C./min. After the temperature rise, the content of the flask was kept stirring for 20 minutes at 80° C. at 100 rpm. Subsequently, sodium hydroxide was added to adjust the pH of the flask content to 7. Then, the content of the flask was cooled to room temperature to obtain a liquid containing the electrostatic latent image developing toner.

Next, the washing process was conducted in the following manner. With the use of a Büchner funnel, the wet cake of the toner was filtrated out from the liquid containing the electrostatic latent image developing toner. The wet cake of the toner was again dispersed in ion exchanged water to wash the toner. The process of filtrating and dispersing were repeated five times.

Then, the drying process was conducted in the following manner. First, 2 g of the collected electrostatic latent image developing toner was dispersed in 20 g of water. The toner was collected when the conductivity of the dispersion reached 10 μS/cm. Then, the collected toner was dried by being left to stand for 48 hours in an atmosphere of 40° C.

To the surfaces of the toner particles in the toner thus dried, hydrophobic silica was added as an external additive such that the amount of the hydrophobic silica added was 0.5% by mass with respect to the total amount of the toner. As a result, the electrostatic latent image developing toner of Example 1 was obtained. The hydrophobic silica was prepared in the following manner. First, commercially available silica ("RA-200H" manufactured by Nippon Aerosil Co., Ltd.) was crushed by using a jet mill ("IDS-2 Model" manufactured by Nippon Pneumatic Mfg. Co., Ltd.) such that the resultant particles would have a predetermined specific surface. Next, 100 parts by mass of the crushed silica particles were put into a hermetic-type FM mixer. To the silica particles, 20 parts by mass of a hydrophobization agent (a treating agent prepared by mixing γ-aminopropyltriethoxysilane with dimethyl silicone oil at a 1:1 mass ratio) was uniformly sprayed. The resultant particles were mixed for reaction at 110° C. for two hours to impart the hydrophobic characteristics. Subsequently, the product resulting from the side reaction was removed under reduced pressure. The particles left unremoved were heated at 200° C. for one hour to prepare hydrophobic silica.

Examples 2 to 4

The electrostatic latent image developing toners of Examples 2 to 4 were obtained in the same manner as Example 1, except that the reaction temperatures in the respective resinifying processes were changed as shown in Table 1 below.

Example 5

The electrostatic latent image developing toner of Example 5 was obtained in the same manner as Example 2, except that titanium oxide particulates ("TAF-1500" manufactured by Fuji Titanium Industry Co., Ltd., a particle diameter of 10 nm or more and 50 nm or less, and a pencil hardness of 8H or a higher grade) were used instead of silica particulates present within the shell layers.

Example 6

The electrostatic latent image developing toner of Example 6 was obtained in the same manner as Example 5, except that the reaction temperature in the resinifying process was changed to 60° C.

Comparative Example 1

The electrostatic latent image developing toner of Comparative Example 1 was obtained in the same manner as Example 2, except that acrylic resin particulates ("MP-1000" manufactured by Soken Chemical & Engineering Co., Ltd. and having a particle diameter of 50 nm or more and 200 nm or less and a pencil hardness of 2H) were used instead of the silica particulates present within the shell layers.

Comparative Example 2

The electrostatic latent image developing toners of Comparative Example 2 was obtained in the same manner as Comparative Example 1, except that the reaction temperature in the resinifying process was changed to 60° C.

Comparative Example 3

The electrostatic latent image developing toner of Comparative Example 3 was obtained in the same manner as Example 2, except that no particulates were contained in the shell-layer-forming liquid.

Comparative Example 4

The electrostatic latent image developing toners of Comparative Example 4 was obtained in the same manner as Comparative Example 3, except that the reaction temperature in the resinifying process was changed to 60° C.

Example 7

The electrostatic latent image developing toner obtained in Example 3 was used, and the fixing load was adjusted to 4 N/cm$^2$ by changing the nip width to 7.2 mm and the load applied by the roller of the fixing unit from 120 N to 70 N. Under this condition, the fixing temperature of Example 7 was evaluated.

Example 8

The electrostatic latent image developing toner obtained in Example 3 was used, and the fixing load was adjusted to 8 N/cm$^2$ by changing the nip width to 8.7 mm and the load applied by the roller of the fixing unit to 160 N. Under this condition, the fixing temperature of Example 8 was evaluated.

Example 9

The electrostatic latent image developing toner obtained in Example 3 was used, and the fixing load was adjusted to 10 N/cm$^2$ by changing the nip width to 9.5 mm and the load applied by the roller of the fixing unit to 220 N. Under this condition, the fixing temperature of Example 9 was evaluated.

Comparative Example 5

The electrostatic latent image developing toner obtained in Comparative Example 4 was used, and the fixing load was adjusted to 4 N/cm$^2$ by changing the nip width to 7.2 mm and the load applied by the roller of the fixing unit to 70 N. Under this condition, the fixing temperature of Comparative Example 5 was evaluated.

Comparative Example 6

The electrostatic latent image developing toner obtained in Comparative Example 4 was used, and the fixing load was adjusted to 8 N/cm$^2$ by changing the nip width to 8.7 mm and the load applied by the roller of the fixing unit to 160 N. Under this condition, the fixing temperature of Comparative Example 6 was evaluated.

The following describes the evaluation method and the measurement method used for the respective electrostatic latent image developing toners obtained in Examples and Comparative Examples.

(1) Shell Layer Hardness Test

In 2.0 g of aqueous hydrochloric acid adjusted to have the pH of 4, 1.0 g of an aqueous solution containing initial polymers of hexamethylolmelamine ("Mirben resin SM-607" manufactured by Showa Denko K.K. and having a solid concentration of 80% by mass) was dissolved to obtain a dissolved matter. The dissolved mater was dripped onto a glass plate and spread thin. The temperature of the glass plate (that is, the reaction temperature of the monomer or the prepolymer of the melamine resin) was changed from 50° C. to 80° C. in steps of 10° C. as shown in the "reaction temperature" in Tables 1 and 2 below. In this manner, a melamine resin film was formed on each glass plate to prepare the respective samples. Thereafter, each glass plate was heated for 20 minutes at a corresponding reaction temperature described above for the monomer or the prepolymer of the melamine resin. Thereafter, sodium hydroxide was added to adjust the pH to 7, followed by drying. Then, each resin film formed on the glass plate was subjected to the pencil hardness test according to JIS K5600. The hardness of each resin film thus measured was determined as the hardness of the shell layers of the toner particles in a corresponding one of the electrostatic latent image developing tones of Examples and Comparative Examples.

(2) Lowest Fixing Temperature

Each of the electrostatic latent image developing toners of Examples and Comparative Examples was subjected to the fixing process with the use of a heating and pressurizing fixing unit as shown in FIG. 4. More specifically, the fixing temperature was changed from 100° C. to 200° C. in steps of 5° C. to fix 1.0 mg/cm$^2$ of the electrostatic latent image developing toner on a 90 g/m$^2$ sheet of paper (recording medium). Each fixing state was then visually inspected. The lowest temperature at which the toner was favorably fixed was determined as a lowest fixing temperature. Note that the lowest temperature was measured under the conditions of the fixing speed of 230 mm/sec, the nip width of 8 mm, and the nip passage time of 35 msec.

The following describes the structure of the fixing unit used in the measurements and evaluations. The heating roller includes a core bar (ϕ26 mm) made of 1-mm-thick aluminum and a 300-nm-thick silicone rubber layer coating the core bar. The silicone rubber layer is coated with a release layer that is a 30-nm-thick paraformaldehyde resin tube. The heating roller is provided with a halogen heater disposed inside the heating roller and is heated by radiation heat of the heater. The heating roller is provided with a temperature measuring member to measure the temperature of the heating roller, and the power supply to the heater is controlled based on the measurement results. The pressure roller includes a core bar (ϕ2 mm), an 8-mm-thick silicone rubber layer coating the core bare, and a paraformaldehyde resin tube coating the silicone rubber layer.

(3) Fixing Load

Each of the electrostatic latent image developing toners of Examples and Comparative Examples was subjected to the fixing process with the use of a heating and pressurizing fixing unit as shown in FIG. 4. Then, the load applied for each fixing process (fixing load) was measured. The pressure roller was pressed to receive a load of 120 N to form a fixing nip. With this state, the fixing load was calculated. With the load of 120 N on the pressure roller and the nip width of 8 mm, the fixing load was 6 N/cm$^2$. The fixing load was changed by changing the load applied to the pressure roller and the nip width. The fixing load applied in each of Examples 7 to 9 and Comparative Examples 5 and 6 was changed by changing the load applied by the pressure roller and the nip width.

Table 1 collectively shows the evaluation results of Examples 1 to 6 and Comparative Examples 1 to 4. In addition, Table 2 collectively shows the evaluation results of Examples 3 to 9 and Comparative Examples 4 to 6.

TABLE 1

| | Hardness of Toner | Reaction Temperature in Shell Layer Formation Process | Hardness of Shell | Particulates Present within Shell Layer | | | Fixing Load | Lowest Fixing Temperature |
|---|---|---|---|---|---|---|---|---|
| | Cores | ° C. | Layer | Type | Hardness | Relation in Hardness | N/cm$^2$ | ° C. |
| Example 1 | H | 80 | 6H | Silica | 8H or higher | Toner Core < Shell Layer < Particulates | 6 | 170 |
| Example 2 | H | 70 | 5H | Silica | 8H or higher | Toner Core < Shell Layer < Particulates | 6 | 165 |
| Example 3 | H | 60 | 4H | Silica | 8H or higher | Toner Core < Shell Layer < Particulates | 6 | 160 |
| Example 4 | H | 50 | 4H | Silica | 8H or higher | Toner Core < Shell Layer < Particulates | 6 | 155 |
| Example 5 | H | 70 | 5H | Titanium | 8H or higher | Toner Core < Shell Layer < Particulates | 6 | 165 |
| Example 6 | H | 60 | 4H | Titanium | 8H or higher | Toner Core < Shell Layer < Particulates | 6 | 160 |
| Comparative Example 1 | H | 70 | 5H | Acrylic | 2H | Toner Core < Particulates < Shell Layer | 6 | 170 |
| Comparative Example 2 | H | 60 | 4H | Acrylic | 2H | Toner Core < Particulates < Shell Layer | 6 | 165 |
| Comparative Example 3 | H | 70 | 4H | Not Contained | — | Toner Core < Shell Layer | 6 | 170 |
| Comparative Example 4 | H | 60 | 4H | Not Contained | — | Toner Core < Shell Layer | 6 | 165 |

TABLE 2

| | Hardness of Toner | Reaction Temperature in Shell Layer Formation Process | Particulates Present within Shell Layer | | | Fixing Load |
|---|---|---|---|---|---|---|
| | Cores | ° C. | Type | Hardness | Relation in Hardness | N/cm$^2$ |
| Example 3 | H | 60 | 4H Silica | 8H or higher | Toner Core < Shell Layer < Particulates | 6 |
| Example 7 | H | 60 | 4H Silica | 8H or higher | Toner Core < Shell Layer < Particulates | 4 |
| Example 8 | H | 60 | 4H Silica | 8H or higher | Toner Core < Shell Layer < Particulates | 8 |
| Example 9 | H | 60 | 4H Silica | 8H or higher | Toner Core < Shell Layer < Particulates | 10 |
| Comparative Example 4 | H | 60 | 4H Not Contained | — | Toner Core < Shell Layer | 6 |
| Comparative Example 5 | H | 60 | 4H Not Contained | — | Toner Core < Shell Layer | 4 |
| Comparative Example 6 | H | 60 | 4H Not Contained | — | Toner Core < Shell Layer | 8 |

To clearly show the effect of the present disclosure, Table 2 shows the evaluation results on Example 3 and Comparative Example 4, which are already shown in Table 1.

The electrostatic latent image developing toners according to Examples of the present disclosure contained toner particles each having a shell layer within which particulates (silica particulates or titanium oxide particulates) of a higher hardness than the shell layers were present. As is apparent from Table 1, the electrostatic latent image developing toners according to the present disclosure all achieved to reduce the fixing temperature.

As is apparent from the comparison between Examples 1 and 2, an increase in the reaction temperature in the resinifying process resulted in a higher hardness of the shell layers. Therefore, the temperature for fixing the resultant electrostatic latent image developing toner tended to be higher.

The comparison between Example 2 and Comparative Example 1 reveals that the electrostatic latent image developing toner containing acrylic resin particulates having a lower hardness than the shell layers failed to reduce the fixing temperature despite the presence of the particulates within the shell layers.

As is apparent from Table 2, with the toner particles including the shell layers within which the particulates having a higher hardness than the shell layers are present, each electrostatic latent image developing toner achieved to reduce the fixing temperature without changing the fixing load. In addition, such an electrostatic latent image developing toner achieved to reduce the fixing temperature by increasing the fixing load.

In addition, with the fixing load of 4 N/cm$^2$, the effect achieved for the electrostatic latent image developing toner was insufficient despite the presence of particulates having a higher hardness than the shell layers within the shell layers.

What is claimed is:

1. An electrostatic latent image developing toner comprising toner particles, wherein each toner particle includes a toner core containing a binder resin, a shell layer coating a surface of the toner core, and particulates having a higher hardness than the shell layer, and each shell layer contains a thermosetting resin, the particulates are disposed in a state of being caused to adhere directly to the surface of the toner core, the particulates are present within the shell layer, and the particulates are coated with the shell layer to form protuberances.

2. An electrostatic latent image developing toner according to claim 1, wherein a content of the particulates in the toner particles is 0.1% by mass or more and 5.0% by mass or less with respect to a total amount of the toner particles.

3. An electrostatic latent image developing toner according to claim 1, wherein a primary particle diameter of each particulate is 10 nm or more and 100 nm or less.

4. An electrostatic latent image developing toner according to claim 1, wherein the particulates are silica particulates or titanium oxide particulates.

5. An electrostatic latent image developing toner according to claim 1, wherein the thermosetting resin is a melamine resin or a urea resin.

6. An electrostatic latent image developing toner according to claim 1, wherein the toner core contains neither a charge control agent nor a magnetic powder, and the thermosetting resin contained in the shell layer is a melamine resin.

* * * * *